US011151975B2

(12) United States Patent
Sobol et al.

(10) Patent No.: US 11,151,975 B2
(45) Date of Patent: Oct. 19, 2021

(54) APPARATUS AND METHOD FOR SOUND WAVE GENERATION

(71) Applicant: ZEROSOUND SYSTEMS INC., Calgary (CA)

(72) Inventors: Raymond Sobol, Kelowna (CA); Norm W. Bogner, Calgary (CA); Christian Parker, Cochrane (CA); Simon Schmitt, Calgary (CA); Thomas Apperley, Calgary (CA)

(73) Assignee: Zerosound Systems Inc., Calgary (CA)

( * ) Notice: Subject to any disclaimer, the term of this patent is extended or adjusted under 35 U.S.C. 154(b) by 21 days.

(21) Appl. No.: 16/856,525

(22) Filed: Apr. 23, 2020

(65) Prior Publication Data

US 2020/0251084 A1 Aug. 6, 2020

Related U.S. Application Data

(63) Continuation-in-part of application No. 16/403,250, filed on May 3, 2019, now Pat. No. 10,665,219, (Continued)

(51) Int. Cl.
*G10K 11/178* (2006.01)
*H04R 3/00* (2006.01)
*H04R 1/40* (2006.01)

(52) U.S. Cl.
CPC ..... *G10K 11/1785* (2018.01); *H04R 1/406* (2013.01); *H04R 3/005* (2013.01)

(58) Field of Classification Search
CPC ... H04R 1/00; H04R 1/04; H04R 1/20; H04R 1/32; H04R 1/40; H04R 1/406; (Continued)

(56) References Cited

U.S. PATENT DOCUMENTS 2,972,018 A 2/1961 Hawley et al.
3,136,867 A 6/1964 Brettell
(Continued)

FOREIGN PATENT DOCUMENTS

JP 2006349979 A 12/2006
WO WO 2017216250 A1 12/2017

OTHER PUBLICATIONS

Colin H. Hansen, Does Active Noise Control have a Future, Research Gate, Manuscript No. 1226U, May 30, 2014, https://www.researchgate.net/publication/228780401.
(Continued)

*Primary Examiner* — Thang V Tran
(74) *Attorney, Agent, or Firm* — Bennett Jones LLP

(57) ABSTRACT

A method for sound wave generation includes sensing one or more characteristics of a sound wave; calculating an inverted sound wave based on the one or more characteristics; and emitting the inverted sound wave by flowing a current, selected according to the inverted sound wave, through a wire under tension that passes through a positive pole of a magnet and a negative pole of the magnet, thereby causing the wire to vibrate. An apparatus for sound wave generation includes a microphone configured to detect one or more characteristics of a sound wave detected in a predetermined vicinity of the microphone; a processor coupled to the microphone, configured to calculate an inverted sound wave based on the one or more characteristics; a power supply; and at least one emitter module coupled to the processor, each emitter module including one or more magnets with a positive pole and a negative pole, a wire, made of a conductive material, under tension, that passes between the positive pole and the negative pole, and the power supply configured to deliver a current passing through
(Continued)

the wire, the current selected by the processor to vibrate the wire and thereby emit the inverted sound wave.

18 Claims, 16 Drawing Sheets

Related U.S. Application Data which is a continuation-in-part of application No. 16/262,899, filed on Jan. 30, 2019, now abandoned.

(60) Provisional application No. 62/624,612, filed on Jan. 31, 2018.

(58) Field of Classification Search
CPC ..... H04R 1/1041; H04R 1/1083; H04R 3/00; H04R 3/005; H04R 29/004; H04R 2201/00; H04R 2201/003; H04R 2410/05; G10K 11/175; G10K 11/178; G10K 11/1785; G10K 11/17823; G10K 11/17873
See application file for complete search history.

(56) References Cited

U.S. PATENT DOCUMENTS

| | | | | |
|---|---|---|---|---|
| 4,471,173 | A | 9/1984 | Winey | |
| 4,480,455 | A | 11/1984 | Bramer | |
| 5,297,214 | A * | 3/1994 | Bruney | H04R 7/10 381/408 |
| 5,481,192 | A | 1/1996 | Mehlkopf et al. | |
| 5,748,758 | A * | 5/1998 | Menasco, Jr. | H04R 23/00 381/173 |
| 5,937,070 | A | 8/1999 | Todter et al. | |
| 6,125,189 | A | 9/2000 | Yasuno et al. | |
| 6,192,133 | B1 | 2/2001 | Enamito et al. | |
| 6,760,462 | B1 | 7/2004 | Thigpen | |
| 2001/0046303 | A1 | 11/2001 | Ohnishi et al. | |
| 2005/0231873 | A1 | 10/2005 | Nell | |
| 2009/0067639 | A1 * | 3/2009 | Sugiura | H04M 1/03 381/73.1 |
| 2009/0175484 | A1 | 7/2009 | Saint Vincent et al. | |
| 2009/0209842 | A1 | 8/2009 | Koevoets et al. | |
| 2011/0017545 | A1 | 1/2011 | Pompei | |
| 2012/0087518 | A1 | 4/2012 | Simidian, II et al. | |
| 2013/0208923 | A1 | 8/2013 | Suvanto | |
| 2013/0251176 | A1 | 9/2013 | Goto et al. | |
| 2017/0256251 | A1 | 9/2017 | Krasnov et al. | |
| 2018/0199125 | A1 | 7/2018 | Gabai | |
| 2020/0053473 | A1 * | 2/2020 | Jacques | H04R 9/047 |

OTHER PUBLICATIONS

International Search Report and Written Opinion of the International Search Authority dated Jan. 13, 2020 in respect of PCT/CA2019/050597.

* cited by examiner

APPARATUS AND METHOD FOR SOUND WAVE GENERATION

BENEFIT OF EARLIER APPLICATIONS

This application is a continuation in part of U.S. application Ser. No. 16/262,899, filed Jan. 30, 2019, and of U.S. Ser. No. 16/403,250, filed May 3, 2019 which claim priority from U.S. provisional application 62/624,612, filed Jan. 31, 2018.

TECHNICAL FIELD

The present invention relates to apparatus and methods for sound wave generation in general, and sound wave generation over a plane in particular.

BACKGROUND

Irritating sounds are oftentimes problematic in a wide range of settings including, for example, offices, homes, libraries, cars, outdoor roadways, construction sites, and industrial locations.

Broadly speaking, there are two types of noise reduction, which can be used alone or in combination. The first is passive noise reduction, which is generally achieved by insulating the ear from the external noise. Headphones may be insulated with material that prevents noise from reaching the ear. A room may use techniques known in the art as soundproofing to reduce an occupant's perception of noise coming from outside the room.

The second type of noise reduction is active noise reduction ("ANR"), being a method for reducing noise by emitting a second sound that cancels the unwanted noise. Known algorithms are able to analyze the waveform of a noise, and generate a signal that shifts the phase, or inverts the polarity of, the noise. When a first sound wave meets an inverted (also referred to as "antiphase") sound wave that is equal in both frequency and amplitude, the first and second sound waves effectively cancel each other out. Similarly, when a first sound wave meets a second sound wave with either more or less frequency and amplitude, the first wave is either reduced or amplified accordingly. Generally, active noise reduction as it is currently employed is effective in small areas such as the user's ears for headphones and for hearing aids, and ineffective at larger disperse areas. Using ANR in hearing aids is in addition to their use for amplifying frequencies for hearing impaired. Using ANR in headphones is in addition to their use for playing music.

SUMMARY OF INVENTION

In accordance with a broad aspect of the present invention, there is provided a method for sound wave generation, comprising sensing one or more characteristics of a sound wave; calculating an inverted sound wave based on the one or more characteristics; and emitting the inverted sound wave by flowing a current, selected according to the inverted sound wave, through a wire under tension that passes through a positive pole of a magnet and a negative pole of the magnet, thereby causing the wire to vibrate.

In accordance with another broad aspect of the present invention, there is provided an apparatus for sound wave generation, comprising: a microphone configured to detect one or more characteristics of a sound wave detected in a predetermined vicinity of the microphone; a processor coupled to the microphone, configured to calculate an inverted sound wave based on the one or more characteristics; a power supply; and at least one emitter module coupled to the processor, each emitter module including one or more magnets with a positive pole and a negative pole, a wire, made of a conductive material, under tension, that passes between the positive pole and the negative pole, and the power supply configured to deliver a current passing through the wire, the current selected by the processor to vibrate the wire and thereby emit the inverted sound wave.

In accordance with yet another broad aspect of the present invention, there is provided an apparatus for sound wave generation, comprising: a microphone configured to detect one or more characteristics of a sound wave detected in a predetermined vicinity of the microphone; a processor coupled to the microphone, configured to calculate an inverted sound wave based on the one or more characteristics; a power supply; a first plate and a second plate arranged in parallel planes with a space between them, each plate being a planer member; a membrane under tension being positioned in the space between the first plate and the second plate; and at least one emitter module coupled to the processor, each emitter module including four or more magnets, each with a positive pole and a negative pole, including first, second, third, and fourth magnets, each being elongate and planar, arranged in a rectangular shape such that each occupies a corner of the rectangular shape, the first and third magnets oriented such that their north poles face each other, the second and fourth magnets oriented such that their south poles face each other, the first and second magnets being coupled to the first plate, the third and fourth magnets being coupled to the second plate, defining a centre line between the four magnets; a wire, made of a conductive material, coupled to the membrane and thereby being under tension, positioned such that the wire extends substantially along the centre line, and the power supply configured to deliver a current passing through the wire, the current selected by the processor to vibrate the wire and thereby emit the inverted sound wave.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

(i)

(ii)

(iii)

(iv)

(v)

(vi)

(vii)

(viii)

(ix)

(x)

(xi)

(xii)

(xiii)

(xiv)

(xv)

(xvi)

(xvii)

(xviii)

(xix)

(xx)

(xxi)

(xxii)

DETAILED DESCRIPTION OF EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

The apparatus and methods described herein are discussed using the illustrative example of noise reduction. It is to be understood that the apparatus and methods may have additional uses, including, for example, extinguishing fires.

Algorithms are able to process a waveform into an inverted sound waveform. For example, a noise-reducing headphone may include a microphone to detect a noise, a computer to process the noise and calculate the inverted waveform, and a speaker to emit a sound corresponding to the inverted waveform. The inverted noise waveform may be amplified and a transducer may create a sound wave proportional to the amplitude of the noise, creating destructive interference with the noise. Such destructive interference may make noise less perceptible to a listener. In this paper, it shall be understood that the terms "noise" and "sound" may be used interchangeably.

Figure 8:
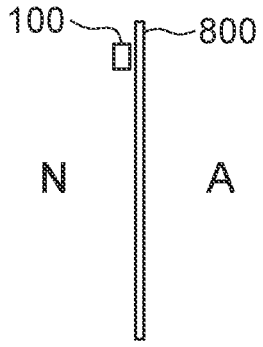
FIG. 8 is a top plan view of a sound wave generation apparatus.

Active noise reduction in headphones reduces noise only for a person wearing the headphones. In other words, ANR headphones are able to reduce noise at one point on a plane. It will be appreciated that it would be desirable to design a structure, such as a wall or fence, with ANR properties, such that noise can be actively reduced in an area A (FIG. 8) on an opposite side of the structure where noise N is occurring. This would allow multiple listeners to benefit from ANR in a room without having to wear headphones. The present invention addresses this deficiency in the prior art. The invention may allow for ANR over a plane, including a two-dimensional plane and a three-dimensional plane, i.e., over a flat surface or over a curved surface.

The algorithm may use machine learning by observing or collecting data of the noise the invention encounters in use. The algorithm may be capable of predicting noise and thereby improve the invention's accuracy, or ability to reduce noise accurately.

With reference to the Figs., in one embodiment, the invention includes a sound emitter module 400 with a conductor 410, such as a wire, tensioned on a frame 910 through which a sound passes and may be cancelled. The sound emitter 400 includes a magnet 300 to apply a magnetic force on the tensioned conductor 410. When an electrical current flows through the tensioned conductor 410 that is passing between the poles of the magnet 300, a periodic force perpendicular to the conductor 410 and a magnetic field are produced. This periodic force causes the conductor 410 to vibrate and thereby emit a sound. Altering one or both of i) the forces of the current, and ii) the magnetic field alters the sound wave that the vibrating tensioned conductor 410 emits.

The invention further includes a circuit 900, in which the wire 410 is connected. In one embodiment of the invention, an electrical circuit 900 further includes a transducer and/or a processor 500.

A transducer, such as microphone 100, detects a first sound wave and converts it into an electrical signal. Other single or multiple frequency measurement modules and wave amplitude measurement modules known in the art may be used, in addition to or instead of microphones.

A processor 500 may receive the electrical signal, invert the first sound wave's waveform, and calculate a current that may be sent through wire 410 by a power supply 800 connected to the circuit 900. The current may be calculated by the processor based on a number of factors, which may include the amplitude of the first sound wave, the frequency of the first sound wave, the speed of sound, and the material composition of the wire 410. The processor may be connected to a computer or computer components, including memory, operating systems, software, instructions, and algorithms for the processor to execute.

The power supply 800 may be a battery, a grid power source, and/or a solar panel, for example AC or DC.

Many factors may affect the speed of sound, such as humidity and temperature. It is possible to measure the speed of sound at a given location by placing two microphones in close proximity to one another, for example 0.5 cm-3 cm apart, and comparing the sound waves detected over a period of time, for example 1 s, at both microphones. Sound wave speed between microphone 200 and microphone 100 may be calculated by dividing distance between the microphones by the elapsed time it takes for the sound wave to travel between the microphones 100 and 200. The speed of sound may be taken into account by the processor 500 when determining the current to flow through the wire 410. For example, the calculated speed of sound may be used to determine a delay period between the sound being picked up at the transducer and the sound wave being generated at the emitter module 400 so that the emitter module is driven to generate the appropriate inverted signal when the sound to be mitigated actually arrives at the module, as influenced by the calculated speed of sound. Another method for synchronizing received and emitted sound waves is to i) position a single microphone behind the emitter (that is, on the opposite side of the noise from the emitter), ii) use the microphone to detect the noise, iii) use the processor to determine an inverted signal, and iv) use the processor to correct the emitted signal, thereby improving performance. In such an embodiment, the processor may use, for example, machine learning techniques.

As noted, the emitter module 400 includes wire 410 and magnet 300. The wire 410 is under tension, and passes between the positive pole 310 and the negative pole 320 of the magnet 300. In particular, the magnet 300 has a positive pole 310 and a negative pole 320. The magnet 300 may be one or more magnets. For example, one magnet 300 may be oriented such that its positive pole is on one side of the wire, and its negative pole is on an opposite side of the wire. In another embodiment, two or more magnets 300 are used, such that the negative pole of a first magnet is on one side of the wire, and the positive pole of a second magnet is on another side of the wire. The wire is positioned in the space between the positive and the negative poles such that the magnetic force acts upon the wire. The wires may be installed in a tensioned condition on mounts or there may be tensioners for each wire. Various tensioning methods and devices may be employed to tension the wires, such as a turnbuckle, springs, permanent deflection, or a combination thereof.

Figure 9:
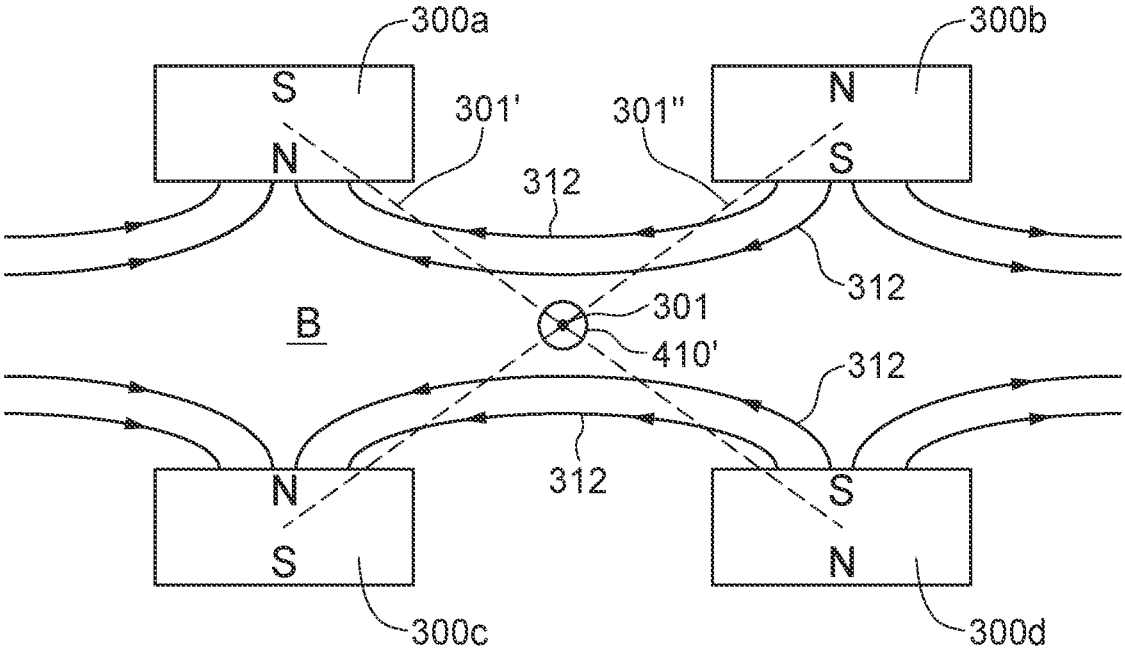
FIG. 9 is a cross-sectional schematic of a magnetic field generated by an arrangement of four magnets.

With reference to FIGS. 9-14, in one embodiment, an apparatus for sound wave generation includes elongate bar-type magnets 300*a-d* and a wire 410' on a membrane 420', plates 330 and a frame with a tensioning apparatus for tensioning the membrane and thereby wire 410'. With reference to FIG. 9, in this embodiment, there are first, second, third, and fourth magnets. The first magnet 300*a* is positioned beside second magnet 300*b*, across from third magnet 300*c*, and diagonally from fourth magnet 300*d*. The first and second magnets are oriented on a first plane, and the third and fourth magnets are oriented on a second plane. The first plane and second plane are parallel to each other with a space therebetween such that the first and third magnets are aligned, and the second and fourth magnets are aligned. In other words, the first and third magnets are lined up with each other, and the second and fourth magnets are lined up with each other. The first and third magnets are in the same position, and the second and fourth are in the same position. In cross section, the four magnets may be arranged in a rectangular shape such that each magnet occupies a corner of the rectangle. The first and third magnets are oriented such that their north poles face each other. The second and fourth magnets are oriented such that their south poles face each other.

This arrangement flattens magnetic field B created by the magnets, as illustrated by the vector lines 312 from south poles to north poles indicating the force exerted on a charged particle in the magnetic field. The magnetic field is concentrated at a centre point 301 that may be near the middle of the rectangle shape defined by the arrangement of the magnets. Centre point 301 is the approximate location of the magnetic field where magnetic force on a charged particle would be the strongest. The centre point may be approximated by the intersection of two lines, the first line 301' drawn from the first magnet diagonally to the fourth, and the second line 301" drawn from the second magnet diagonally to the third. In such an embodiment, wire 410' may be placed at or near point 301. Placing the wire near the centre point 301, where the force of magnetic field B is strongest, promotes efficient transfer of energy from the magnets to the wire.

Figure 10A:
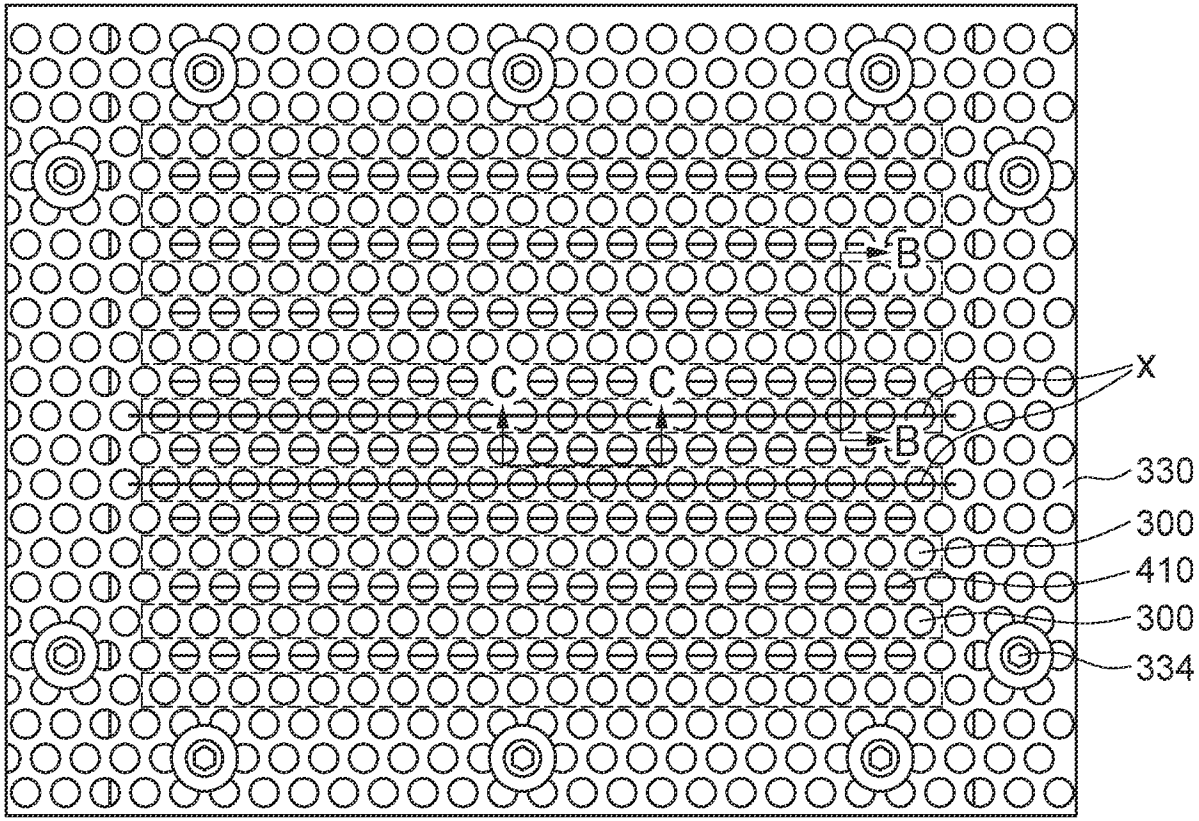
FIG. 10*a* is a front plan view of a sound wave generation apparatus with a membrane, elongate planar magnets, and a plate.
Figure 10B:
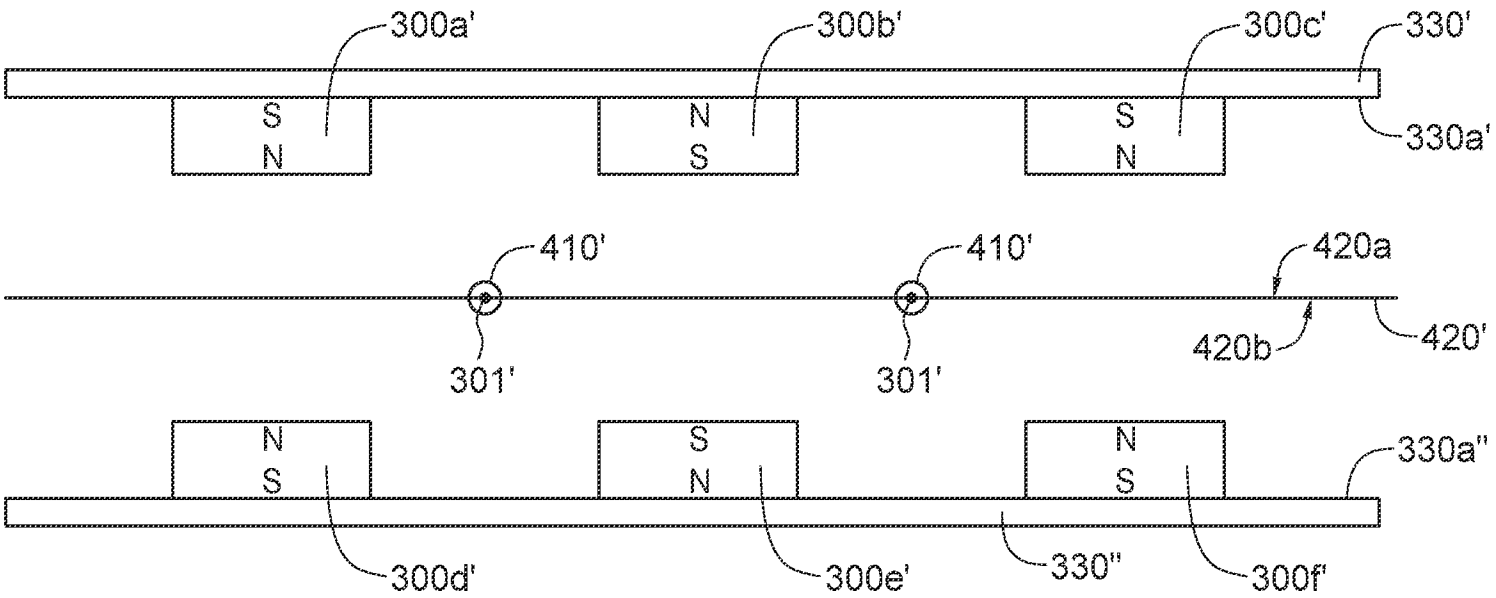
FIG. 10*b* is a cross-sectional schematic of a wire coupled to a membrane sandwiched between two plates, each with three magnets connected thereto.
Figure 10C:
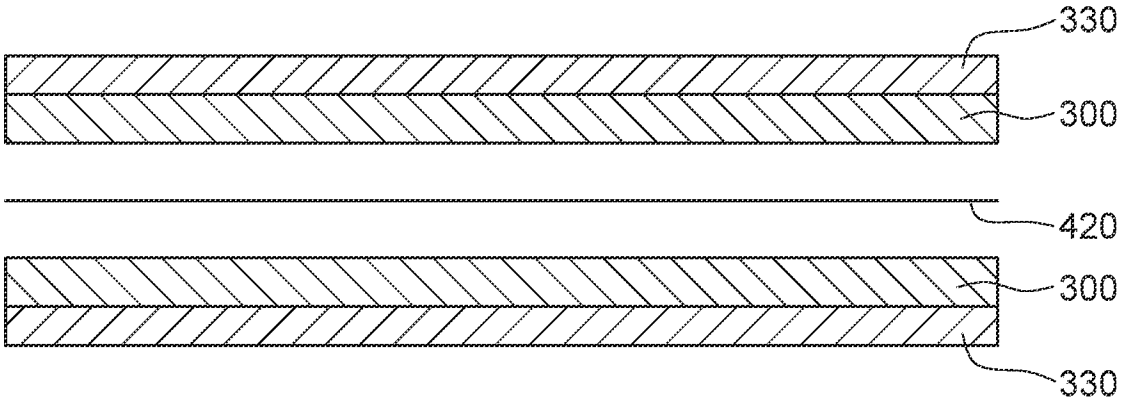
FIG. 10*c* is a cross-sectional schematic of a membrane sandwiched between two plates with magnets secured to each plate between the membrane and the plate.

With Reference to FIGS. 10*a*-10*c*, one or more of the magnets may be connected to one or more plates 330. Magnets may have a substantially elongate planar shape. Magnets may be arranged on plate 330 with their long axis x extending parallel to each other. Magnets may be arranged such that adjacent magnets alternate in respect of direction of polarity. With reference to FIG. 10*b*, a first magnet 300*a'* may have its south pole connected to a first side 330*a'* (which faces membrane 420') of a first plate 330', and a second magnet 300*b'* may have its north pole connected to the first side 330*a'* of plate 330'. A third magnet 300*c'* may have its south pole connected to the first side 330*a'*. A second plate 330" with a corresponding arrangement of magnets may be connected to the first, such that the magnets are aligned with each other. A fourth magnet 300*d'* may have its south pole connected to a first side 330*a"* of second plate 330", and a fifth magnet 300*e'* may have its north pole connected to the first side 330*a"*. A sixth magnet 300*f* may have its south pole connected to the first side 330*a"*.

The wire, which may be disposed on a membrane 420, may be between the plates. First side 330*a'* of first plate 330' may face the membrane's first side 420*a*, and first side 330*a"* of second plate 330" may face membrane's second side 420*b*. The membrane may thereby be sandwiched between the two plates 330' and 330". The wire may be arranged such that it is offset from the magnets. The wire may be positioned such that it is laterally between two magnets. The wire may be positioned at a point 301' such that the wire is within a flattened and/or concentrated magnetic field created by two or more, for example four, magnets.

Each plate may be a substantially planar member. Each plate may be perforated. The plate may be made of a substantially non-magnetic material. Magnets may be connected to the plate, for example by one or more of adhesive, screws, straps, brackets, or other structures or mechanisms.

The current flowing through the wire 410, 410' causes the wire to vibrate and thereby emit a sound. The current is selected by the processor 500 such that the emitted sound will reduce the noticeability of, for example, substantially cancel out, the first sound wave within the vicinity of the wire. The microphone may be within 1 cm of the wire. The microphone may be on the side of the wire closer to the unwanted sound N.

The invention may include a frame 910 on which the emitter module 400 is installed. The frame may include frame components such as a plane with an open area 920 on it, or of rigid elongate members that are connected together to form a polygonal shape with the open area there between. The emitter module 400 is installed on the frame with wire 410 extending under tension across the open area 920. The one or more magnets 100, 200 may be in, on, or integral with the frame. The one or more magnets may be placed across the frame or parts of the frame such that the magnets are positioned 90 degrees to the wire 410. Each wire may have one or more magnets fixed thereto such that the wire may pass between the poles of the magnet. Wire 410 extends between ends of the frame, thereby extending across the opening through which sound may pass. The sound therefore passes through open area 920 and between and past wire 410. Wire 410, therefore, is directly in the path of sound waves and can act on them as they pass. The frame may be electrically non-conducting.

Figure 11:
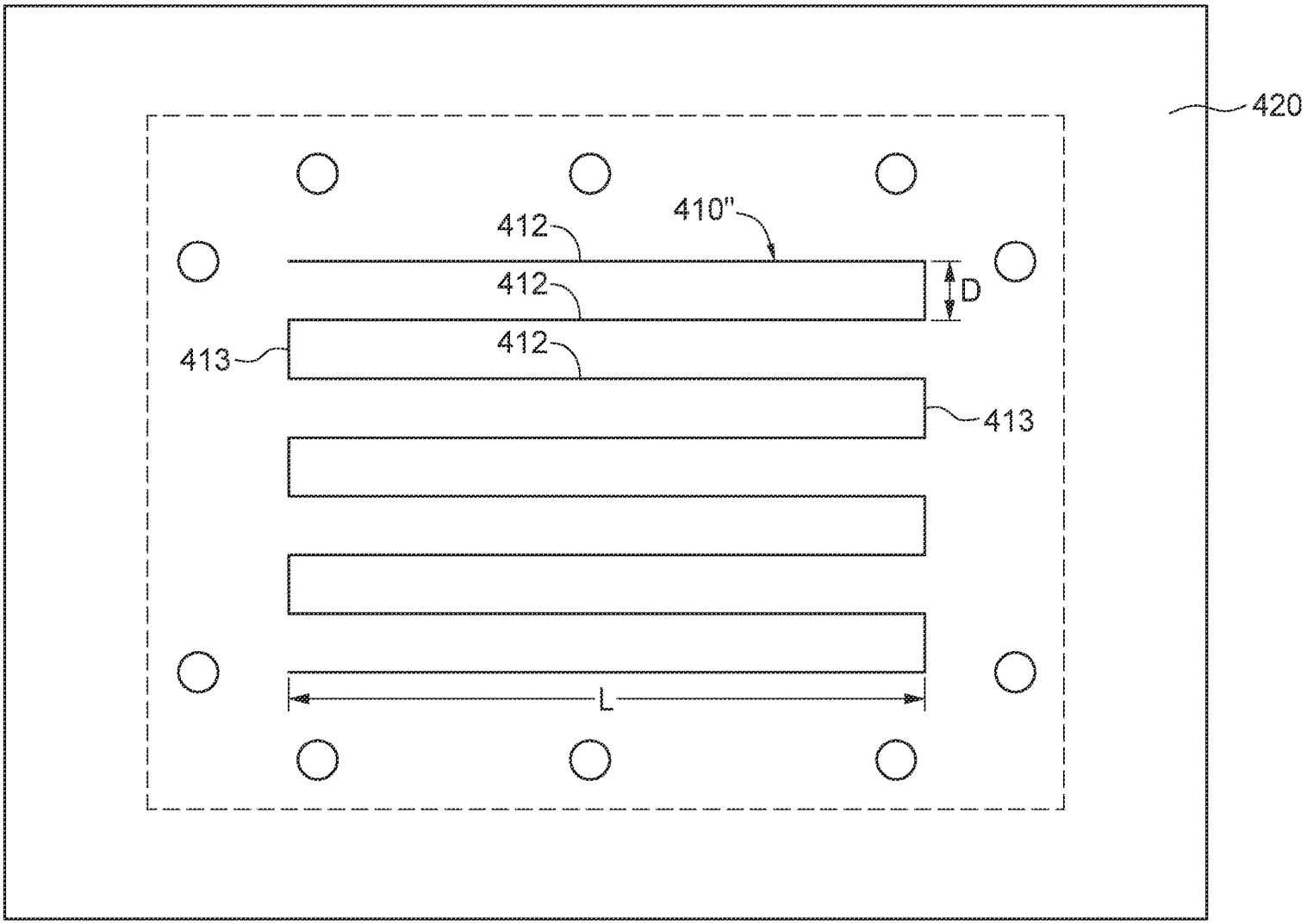
FIG. 11 is a front view of a membrane with a wire coupled thereto.

In one embodiment, there may be multiple wires 410 connected into circuit 900, and possibly to a single processor 500. The wires may be arranged in parallel, or in a grid pattern. Parallel here means the wires 410 may be arranged side by side substantially parallel to one another. Parallel does not necessarily refer to parallel circuitry. Each wire may have the same or a different current passed therethrough. With reference to FIG. 11, in one embodiment, the circuit is constructed of one wire 410". Wire 410" may zig zag such that various lengths 412 of the same wire 410" are parallel with each other. The term zig zag includes that the wire may (i) extend in a first direction by a distance L, (ii) bend at a substantially right angle, (iii) extend in a second direction by a distance D, being shorter than distance L, (iv) bend at a substantially right angle again and (v) extend in a third direction opposite the first direction by distance L, thereby forming lengths 412 of wire. In particular, parts of the wire extending in the first and third directions constitute lengths. It will be appreciated that this is an illustrative arrangement only and other arrangements may create similar lengths of wire 412 that can be driven to create sound, amplified by membrane 420', if present.

If arranged in a grid pattern, the wires 410 may, for example, be oriented at a 90 degree angle with respect to each other, so as to increase air turbulence between the wires in use. The wires may be electrically conductive in one direction, and connected by a non-electrically conductive material in a second direction. For example, conductive wires may run vertically, and non-conductive material may run horizontally (or vice versa), thereby connecting the vertical conductive wires to each other. This would allow the invention to, for example, act as a physical barrier preventing insects from passing therethrough, while allowing fluid communication from one side to the other. If the non-conductive material touches the conductive wires, the non-conductive material may be extendable such that their possible contact with the conductive wires does not quench sound-generating vibration thereof.

Figure 5:
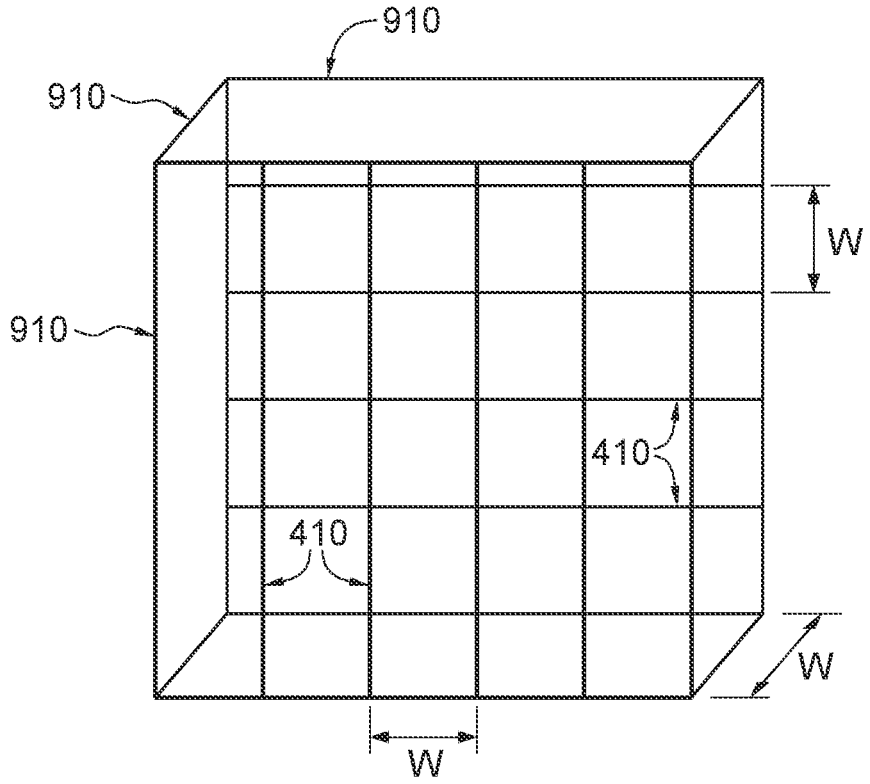
FIG. 5 is a perspective view of a configuration of wires running perpendicular to each other on two spaced apart planes.

As shown in FIG. 5, in another embodiment, there may be two sets of wires 410. A first set of wires 410 may run in a first direction, and a second set of wires 410 may run in a second direction. The second direction may be, for example, substantially 90 degrees from the first direction. For example, the first direction may be vertical, and the second direction may be horizontal. The first set of wires may run along a first plane, and the second set of wires may run along a second plane. The first plane and second plane may be substantially parallel to each other. The planes may be spaced apart such that no wire in the first set touches any wire in the second set when the wires vibrate.

Figure 6:
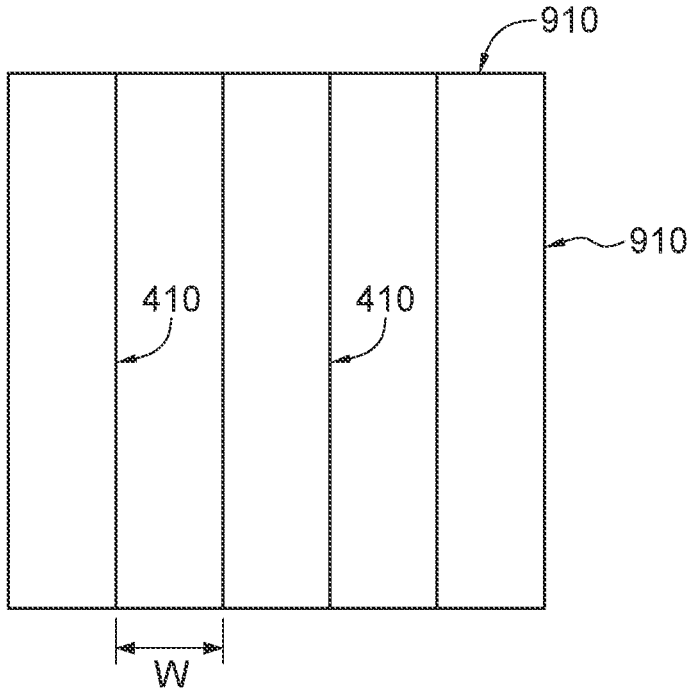
FIG. 6 is a plan view of a configuration of wires on a plane.

To be clear, where there is a plurality of wires 410, in one plane (FIG. 6), or in substantially parallel and spaced apart planes (FIG. 5), wires 410 may be spaced apart such that when vibrating they do not come into physical contact with each other. The distance between wires may be selected based on various factors, including the maximum width W of vibration. When adjacent wires are vibrating at their maximum amplitude (or, alternatively, maximum expected amplitude), the space between the wires will allow the wires to so vibrate freely. The minimum space between wires to allow this is equal to W. For example, wires may be positioned up to 1 cm apart. Wires should generally be at least distance W from anything, such as a surface in or on which the wires are installed, to allow the wires to vibrate freely. Microphones may be positioned near, for example, within 1 cm of one or more of the wires. In one embodiment, microphone 100 is positioned 1 cm away from the wire, and microphone 200 is placed between the wire and the first microphone, for example 0.5 cm away from the wire.

Figure 7:
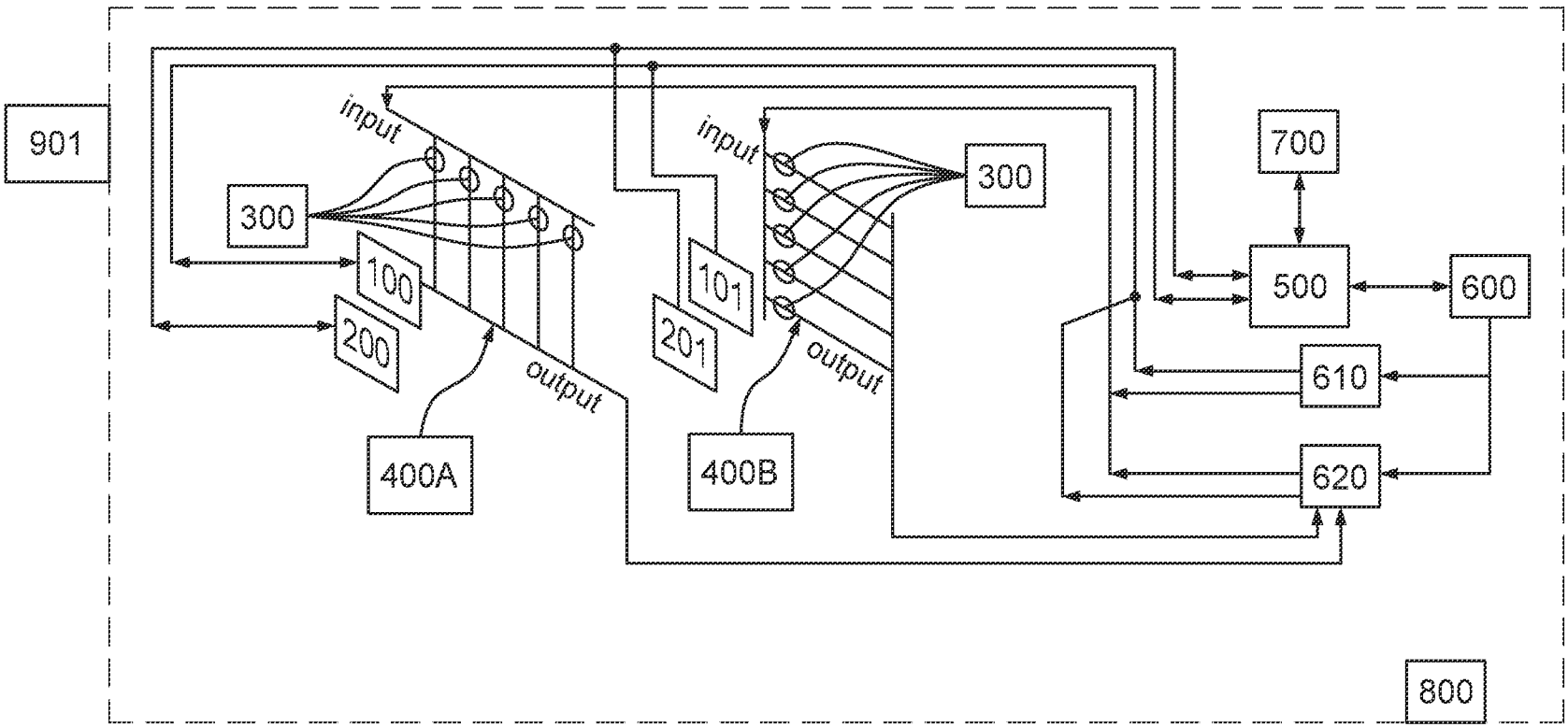
FIG. 7 is a schematic of a sound wave generation apparatus.

FIG. 7 depicts an embodiment of the invention including electronic circuit 901 with two spaced apart conductor grid systems 400A, 400B each including a plurality of spaced apart, substantially oriented in parallel, tensioned conductor wires, each wire with an associated magnet 300 and each wire capable of being driven to emit a sound. While the grid systems could both be driven in response to the operation of one microphone, in this embodiment, each grid system 400A, 400B has at least one microphone for picking up sounds to be reduced. For example, in this embodiment microphones 100, 200 are for driving grid system 400A and microphones 101, 201, are for driving grid system 400B. This embodiment further includes a wifi module 700, processor 500 (the processor including an operating system, memory, software, algorithms, and instructions 600, frequency wave generator module 610, and wave amplifier module 620), and power supply 800.

The wires 410 may each be made of a conductive material, such as aluminum, copper, steel, or an alloy. The wire may be stranded or solid provided it can be tensioned. The wire may have a thickness of about 15-45 gauge or approximately 25-35 gauge. The wire need not be straight and may be a spring. The wire may be electrically insulated. The wire may have a non-conductive coating.

Figure 12:
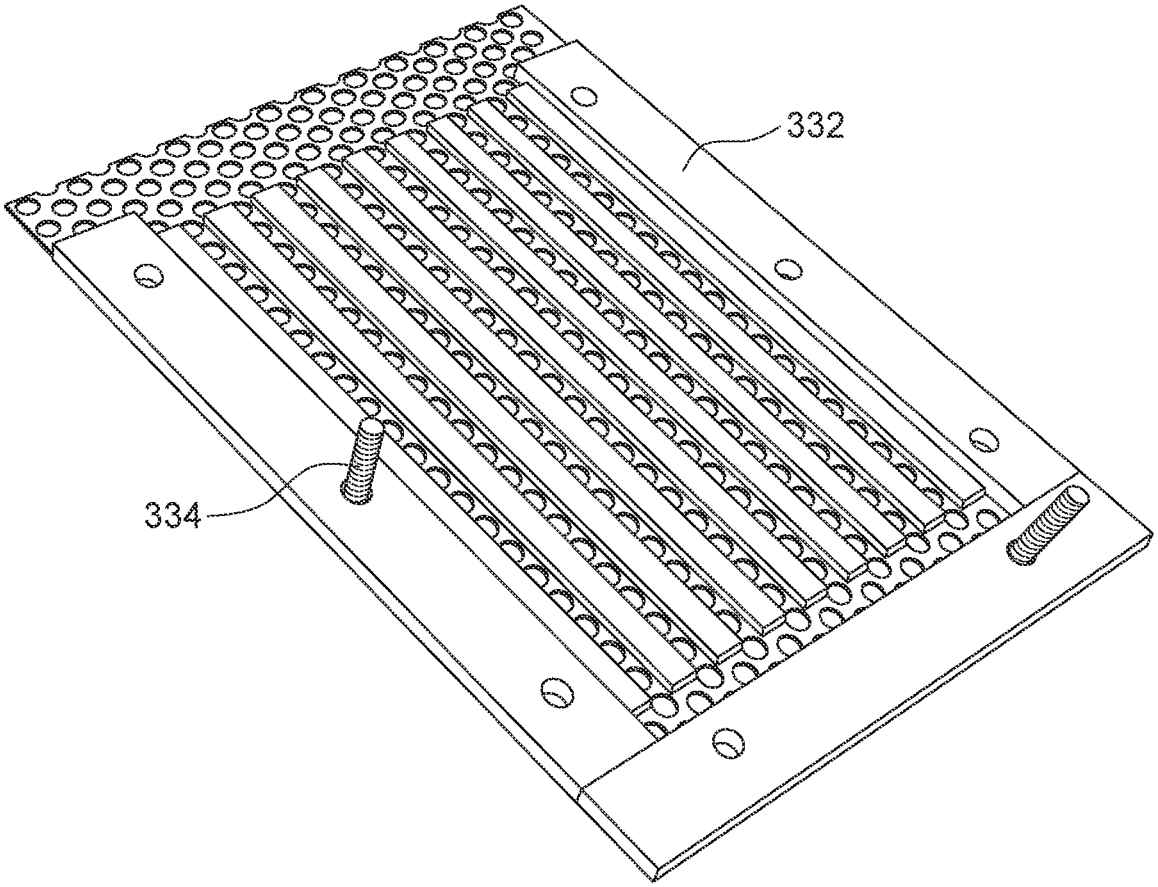
FIG. 12 is a perspective view of a plate with spacers.

The membrane may have various constructions, such as for example two sheets coupled together. With reference to FIG. 11, the wire may be coupled to membrane 420, for example, by being laminated between two sheets of the membrane. The membrane may amplify sound waves emitted by the wire. The membrane may be a thin film. The membrane may be made of a material of a strength and rigidity selected to withstand against tension and force. The membrane may be made of various materials, such as for example polyester or aluminum. The membrane may be secured to the one or more plates 330. The membrane and plate may each have holes, for example positioned along their edges, for receiving one or more pins 334, screws, or the like, to secure the membrane and plate to each other. With reference to FIG. 12, a spacer 332, such as an elongate planer member, may be positioned between the membrane and the magnet and/or plate to create space therebetween for the wires and membrane to vibrate. The spacer may be a flat and narrow rod. The spacer may be made of any number of materials, for example, wood or plastic. The size of the spacer may be selected to adjust the amount of space between the wires and the magnets. The spacer may have holes that may correspond to the holes in the membrane and/or plate for receiving one or more of the pins. There may be one or more spacers, which may be connected to one or more of each other, or may be integral with one or more of each other. Each spacer may extend along an edge of the plate and may thereby line, or track with, the perimeter of the plate.

The membrane may be under tension. The membrane may cause the wires to be under tension. As discussed elsewhere in this application, including at [0022], the wire and/or membrane may be tensioned in any number of ways. In one embodiment, a tensioning element, for example a rod 337 may be connected to the membrane. Pins, such as screws 338, may hold the tensioning element in place.

Figure 13:
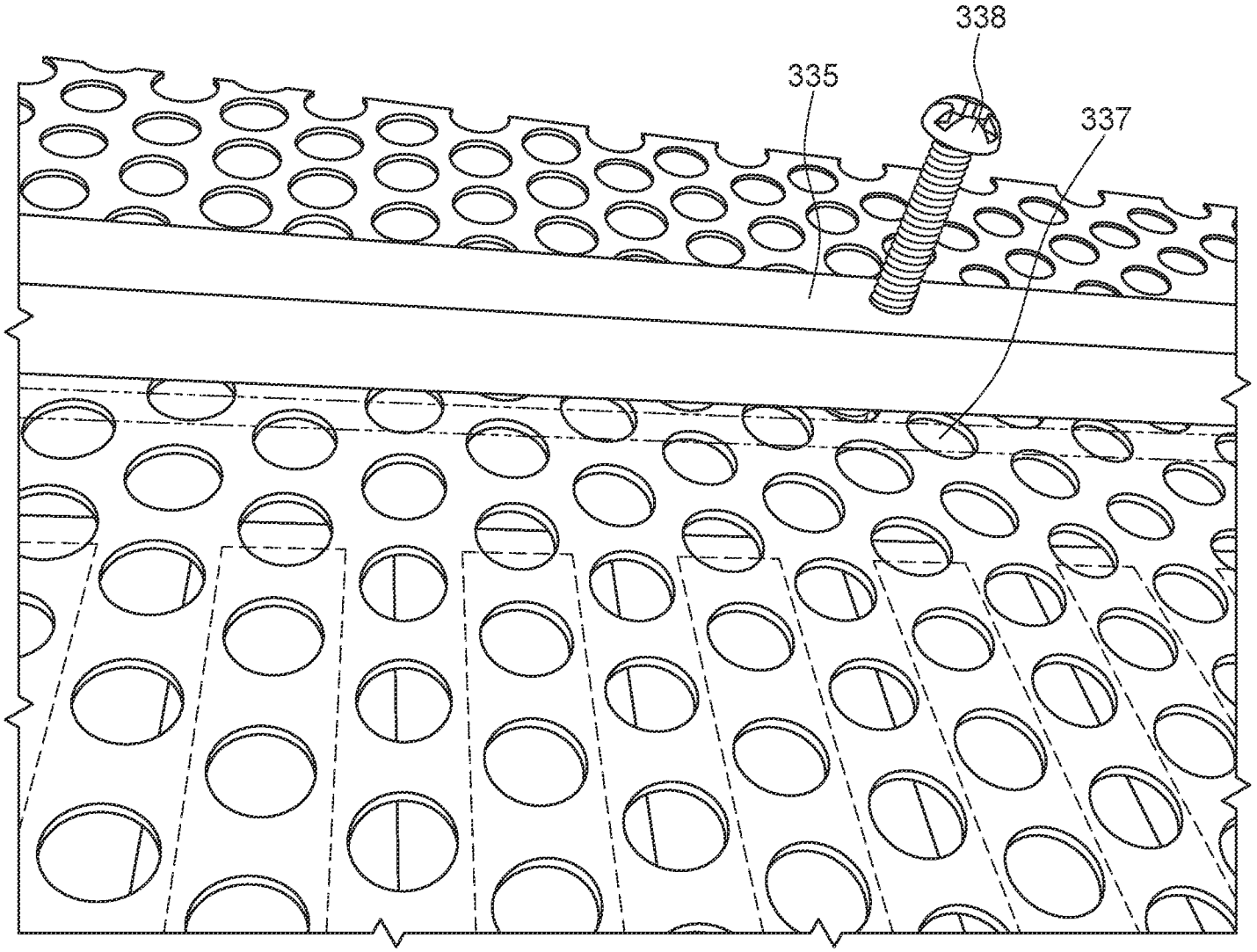
FIG. 13 is a perspective view of a sound wave generation apparatus with a tensioning apparatus.
Figure 14:
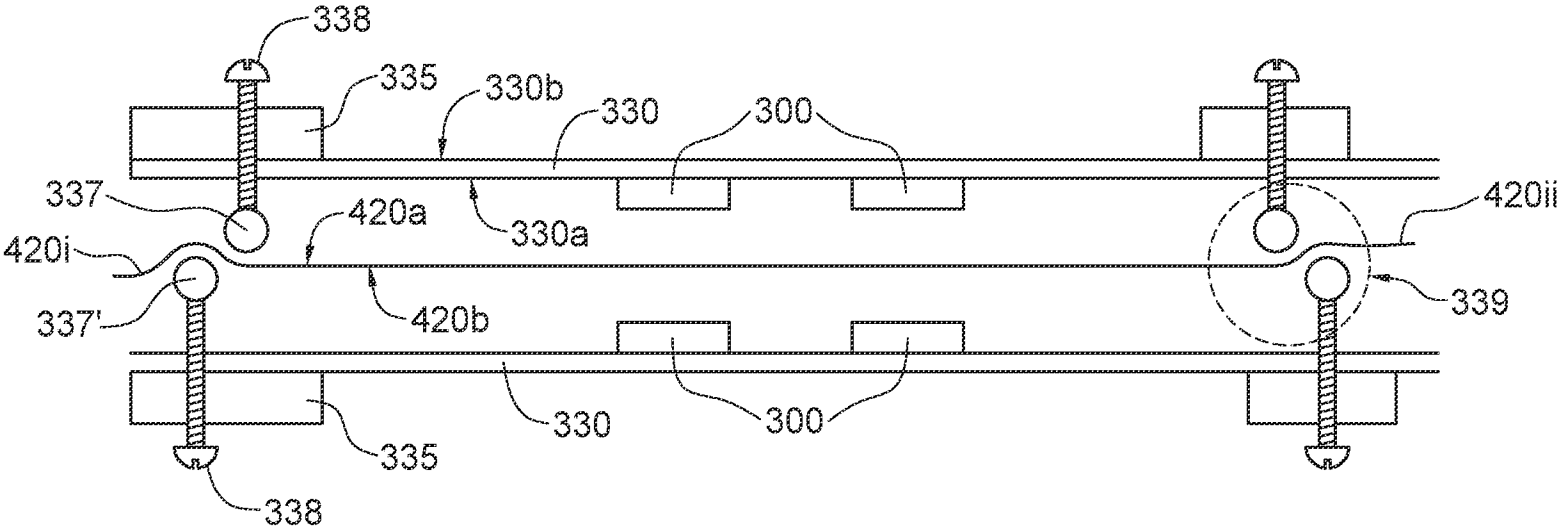
FIG. 14 is a cross-sectional schematic of a sound wave generation apparatus with a tensioning apparatus.

The rod 337 may be positioned between the membrane and the plate 330. The rod may be on the same face 330*a* of the plate as the magnets. The rod may be urged into a first face 420*a* of the membrane near an edge 420*i* of the membrane such that it exerts substantially even force onto the membrane in a substantially straight line over the edge of the membrane. The position of the rod and the tension delivered therefrom may be controlled and/or adjusted, for example, by using one or more screws 338. With reference to FIGS. 13-14, the screws may be aligned using a bar 335 with holes therethrough. The bar may be positioned on the opposite face 330*b* of the plate 330 with respect to the rod. A second rod 337' may be pressed into a second face 420*b* of the membrane. The second rod may be substantially parallel to the first rod such that, together, the two rods cause the membrane to be under tension. Two rods used in such a fashion may be referred to as a rod pair 339. Another rod and/or rod pair may be positioned along another edge 420*ii*, for example parallel to the first edge, to cause the membrane to be under tension between the two edges.

Further Embodiments

The emitter module 400 and frame 910 may together construct a structure, such as a wall, fence, screen, or tarp.

Figure 1:
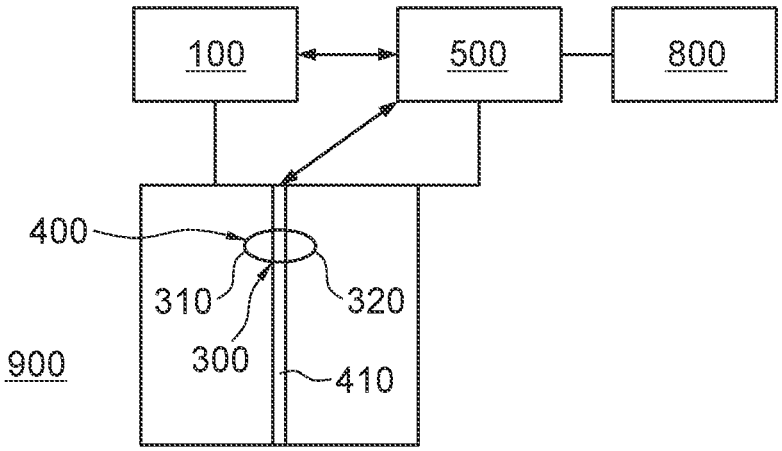
FIG. 1 is a schematic of a sound wave generation apparatus.
Figure 2:
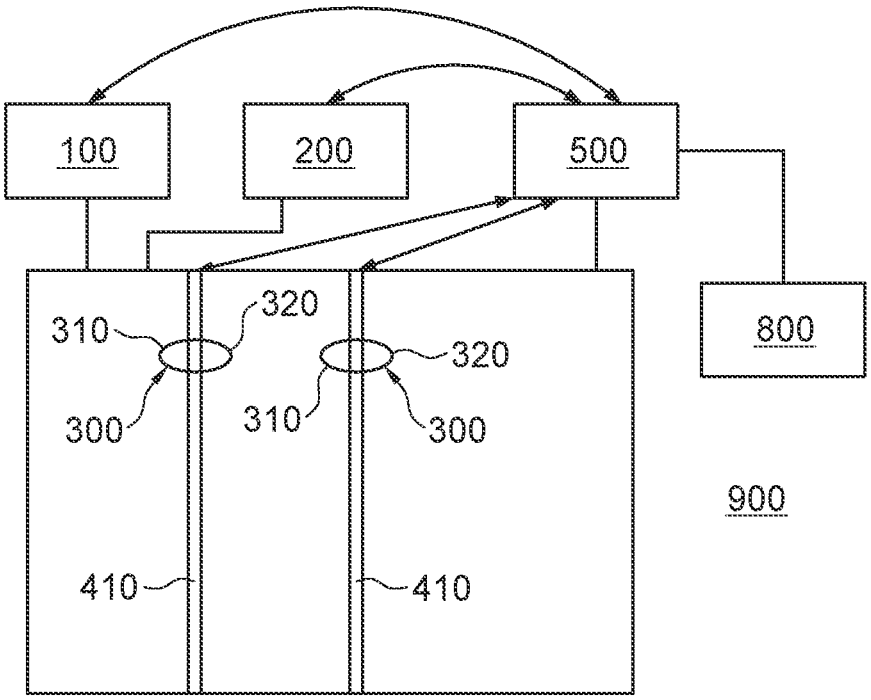
FIG. 2 is a schematic of a sound wave generation apparatus with two emitter modules and two microphones.
Figure 3:
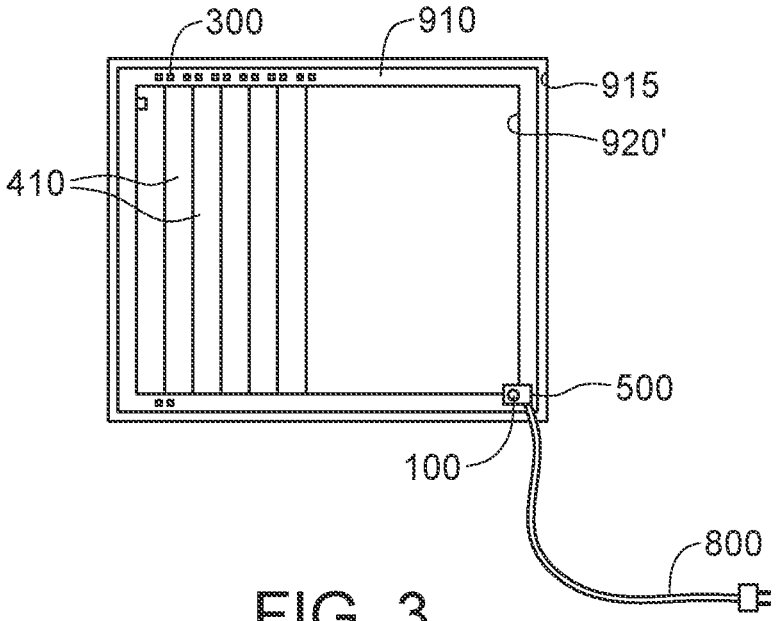
FIG. 3 is an elevation view of a sound wave generation apparatus installed in a screen.

With reference to FIG. 3, the structure, for example, can be a window screen where emitter 400 of one or more tensioned wires 410 for noise mitigation extend in one direction, extending from side to opposite side of the screen frame. The frame 910 can be made of elongate members such as frame extrusions of non-conductive material. Such a screen may allow fluid communication from one side of the screen to the other. Such a screen could be installed in a window opening 915 using, for example, frame extrusions with releasably connectable fasteners 920'. There may further be a transducer 100 coupled to, and protruding a small distance (for example 0.5 to 3 cm) from, an outer facing side thereof, a processor 500, and a power supply 800.

Figure 4:
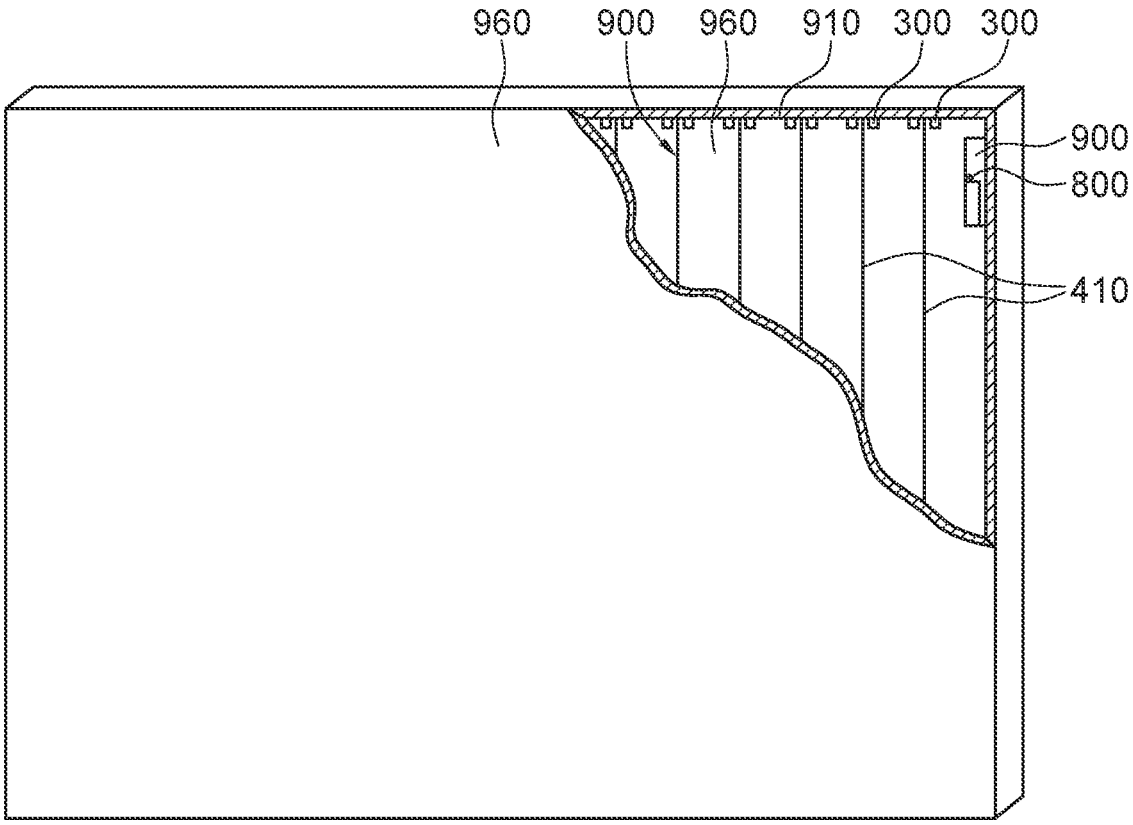
FIG. 4 is a partly cutaway view of a sound wave generation apparatus installed on sheet material.

With reference to FIG. 4, in another embodiment, the emitter module 400 and frame 910 could be installed on or inside a sheet of material or in a gap (as shown) between sheathing such as two sheets of material 960, such as drywall, wood, fabric, metal, concrete, or glass.

Regardless, in the embodiments of FIGS. 3 and 4, the wires 410 of the emitter modules 400 in each embodiment are tensioned and can be driven to emit an inverted waveform to cancel noises picked up by the transducers.

The wires 410 may be tensioned between two opposite sides of the frame 910 on which they are mounted, be it a screen frame, a support frame for sheathing or a frame formed of sheet material. In use, these embodiments could allow a person positioned at multiple points (for example, multiple points within area A on an opposite side of the structure from where noise N is occurring) near the structure to benefit from ANR. Such a structure, being in the path of the travelling sound wave, may also implement passive noise reduction techniques, such as soundproofing. In another embodiment, part or all of the circuit 900 may be built on or into a structure, or be behind a structure. The frame may be non-conductive.

There may be multiple microphones (for example, microphone 100 and microphone 200) at various locations on the structure. In addition to detecting the speed of sound, as discussed above, multiple microphones may serve the additional function of detecting differences in sound at different locations along a structure. This would be especially advantageous in a relatively large space, such as along a road, where sound may vary greatly along the structure. Each wire 410 may have a different current passed therethrough, such that each wire more accurately negates the noise in its vicinity or range. One or more of the plurality of microphones may be monitored continuously, or on a schedule.

Multiple microphones may serve various purposes, including i) synchronization of inbound and emitted (cancelled) soundwaves, and ii) synchronization of cancelled sound waves over large areas. With regard to the former, sound waves in air may be affected by several factors, including wind, air density, temperature, pressure and humidity. When it is desirous to cancel out inbound sound waves, attention must be given to controlling when and where the desired cancellation is to occur. If the signals are not in anti-phase to each other, the cancellation will be less effective or may cause amplification of the undesired sound, thereby increasing the sound. The emitter design resolves the location. By employing two microphones that are physically located at a precise distance from each other and the emitter, the speed of sound can be determined by measuring the sound level and time at the first microphone, then the sound level and time at the second level. Using this method the speed of sound is calculated as speed equals distance divided by time, since existing air conditions are being measured, this formula accounts for air density, temperature, pressure and humidity in real time. Wind also affects speed of sound and its direction my cause a slower or faster speed. The microphones must be in close proximity (within 1 cm) to the emitter to mitigate the changes of wind affects. Closer positioned microphones, both to each other and to the emitter will have higher accuracy in measuring the speed of sound, which when considered by the processor to cancel inbound sound waves at the emitter, thereby improving precision and performance. With regard to the latter, where noise cancellation is desired at larger areas, a single set of microphones may be suitable to measure incoming sound waves, and provide the emitter with effective emitted (cancelling) signals. If needed, sound level measurements can be made across the area to determine if a single set of microphones or a number of sets of microphones are required to best cancel inbound should waves. The processor may be capable of calculating (using the output of the microphone or microphones) changing conditions such as a loud truck passing by a traffic noise barrier. In this example the emitter may be comprised of numerous smaller emitter areas, each of an area equipped with at least one set of microphones, and each area may be independently controlled for providing an individual emitter with effective cancelling signals. An unlimited number of smaller emitters may thus be assembled to perform noise cancellation for larger areas.

Microphones 100, 200 may be tuned to detect sound in a predetermined vicinity of the given microphone, for example within 1 m in any direction, or within 1 m in a given direction or directions. For example, if noise is expected to come from a particular direction relative to the microphone, the microphone may be tuned to pick up sound in that direction. Conversely, the microphones can be tuned to ignore certain directions in order to avoid cancelling sounds originating from such directions. For example, it may be useful to avoid cancelling sounds coming from a smoke detector located at a known place on the ceiling of a room in which the invention is installed.

In embodiments with multiple microphones 100, 200 or multiple emitters 400, the processor 500 may execute an algorithm for synchronizing the components.

The processor 500 may be connected to a network, such as a wired or WiFi network, such that the processor can communicate with other devices. This could also enable remote control of the apparatus, for example for it to be powered on and off remotely. Thus circuit 900 can include wired or wireless configurations.

In one embodiment, rather than using one electrical circuit, the various components can communicate wirelessly, for example using WiFi or Bluetooth. That is, the microphone 100 or 200, processor 500, and emitter 400 of the same embodiment may each have their own circuits and communicate wirelessly.

Example 1

An embodiment of the present invention was tested in a lab at the Southern Alberta Institute of Technology, implementing the methods and materials described in this paragraph. A tensioned wire of approximately 20 gauge was connected between two fixed locations approximately 0.6 metres apart. Two bar magnets were installed at one end of the wire's fixed location such that the wire passed between the poles of the magnet, thereby inducing an electromagnetic force when current was applied. An audio speaker was connected to a signal generator and amplifier, and located to project sound into a box. The box was configured with an approximately 10 cm sound hole (similar to a guitar sound hole), located directly under and within 0.5 cm of the wire. A microphone was installed through the box's side wall to measure sound inside the box. This particular test set up was used to control for ambient sound. It was expected that when the speaker was tuned to emit a sound wave, and the wire was tuned to emit an anti-phase sound wave of the speaker's sound wave, that the sounds emitted by the speaker and the wire would cancel each other out. First, a fixed signal of 146.8 Hz was driven to the speaker, measured in the box and then projected through the sound hole. Second, a fixed anti-phase signal of 146.8 Hz was driven to the wire, resulting is the wire vibrating at the same frequency. Third, the fixed signal of 146.8 Hz and the fixed anti-phase signal of 146.8 Hz were both emitted. Finally, the resulting, combined sound was measured. A sound reduction of greater than 50% was measured.

The present invention may have numerous applications, for example:

(i) Traffic noise barrier, as discussed above;

(ii) Industrial noise protection, such as at a wellbore fracturing (fracking) site, in which the invention is installed in or as a large fence, such as a series of sections of, for example, approximately 20 ft (6.1 m) high by approximately 12 ft (3.7 m) wide, configured to surround or encircle fracking equipment;

(iii) To reduce noise produced by equipment, for example by encircling equipment, including compressors, pumps, engines, air conditioners, and other machinery;

(iv) Indoor noise protection, for example in an office, hospital, or home, in which the invention is used on or in walls or partitions, and may reduce sound or create a quiet room or area;

(v) Automobile noise reduction, for example by installing the invention in the walls or floor of an automobile;

(vi) Aircraft noise reduction, for example, by installing the invention in the walls, ceiling, and flooring of an aircraft; and (vii) Entertainment areas, such as in the walls or tarps of a music venue or tent, or at restaurants, bars and large indoor meeting rooms.

Example 2

Figure 15:
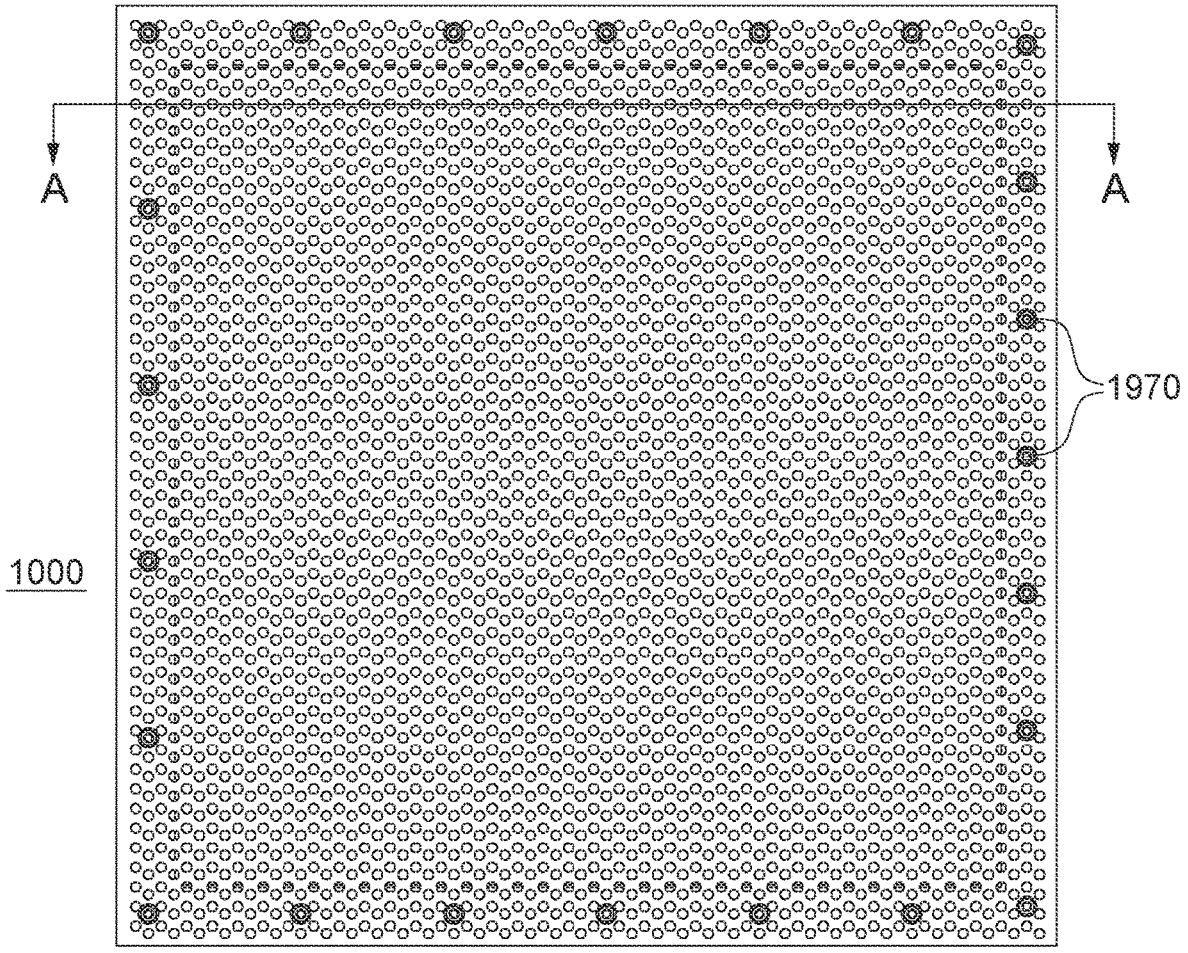
FIG. 15 is a front view of a sound wave generation apparatus.
Figure 15A:
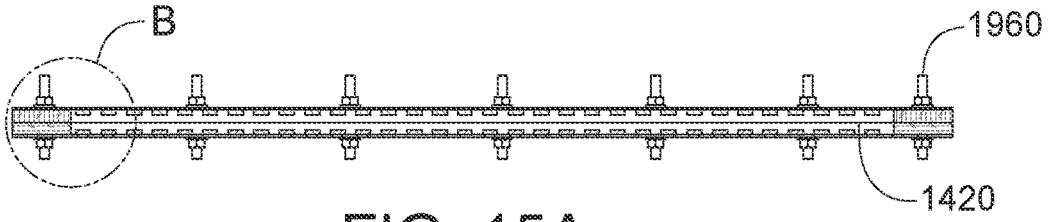
FIG. 15*a* is a cross-sectional view along line A-A in FIG. 15.
Figure 15B:
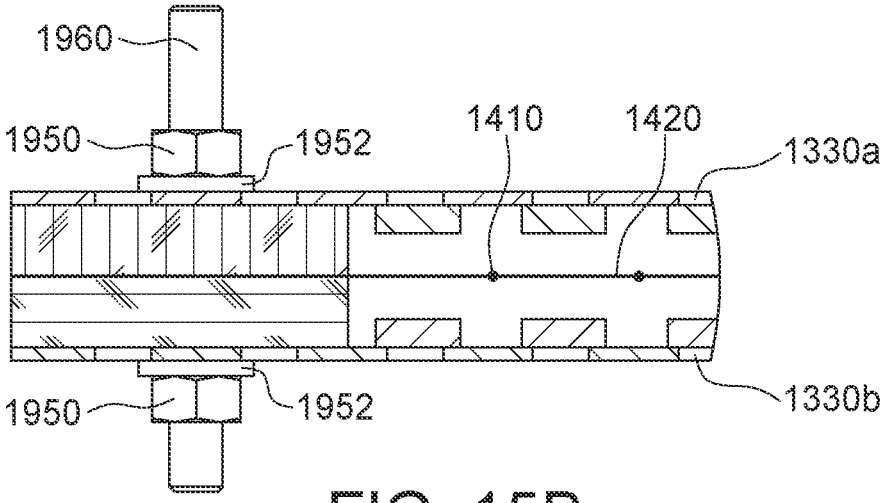
FIG. 15*b* is a detailed view of area B in FIG. 15*a;*
Figure 15C:
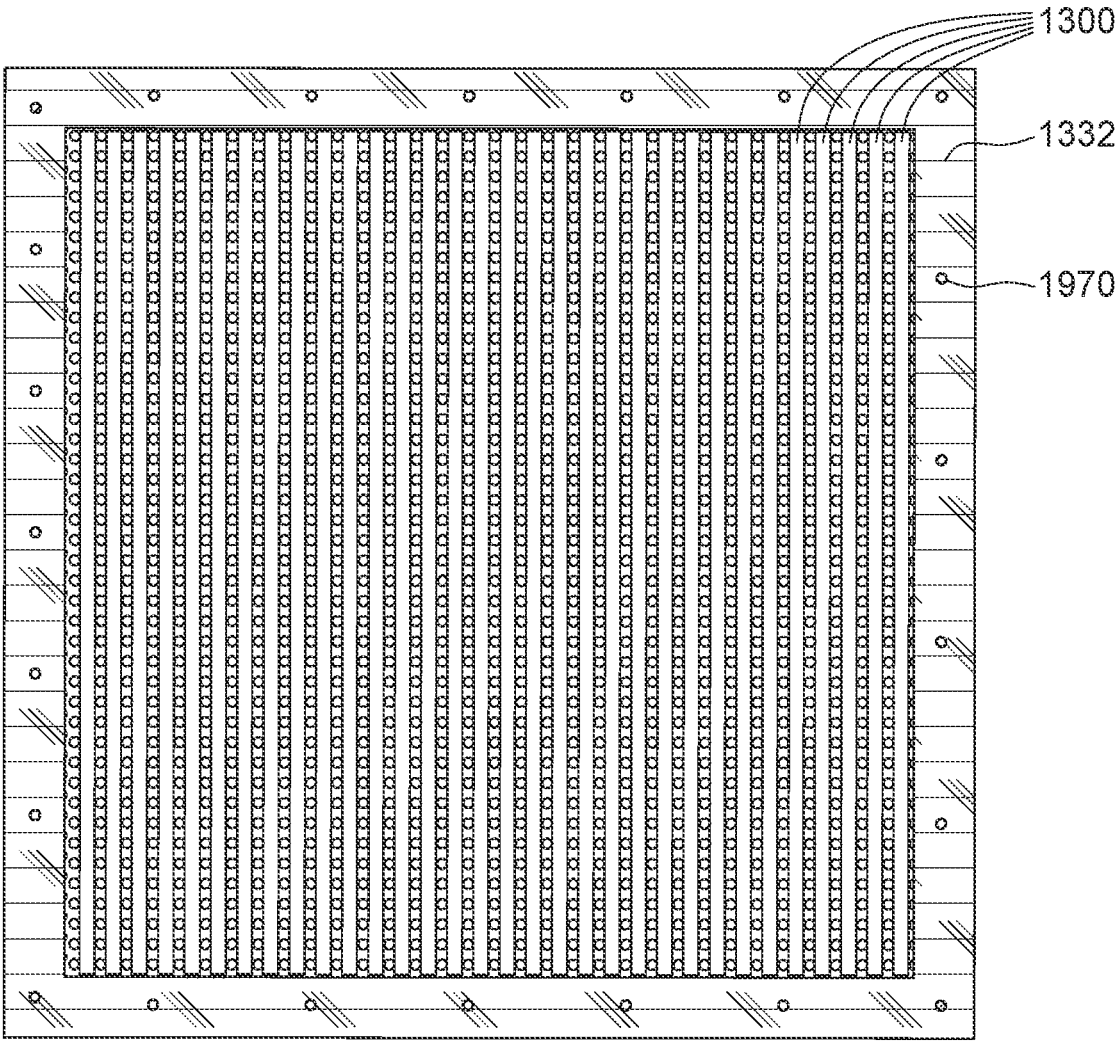
FIG. 15*c* is a cross-sectional view along line C-C in FIG. 15*d;*
Figure 15E:
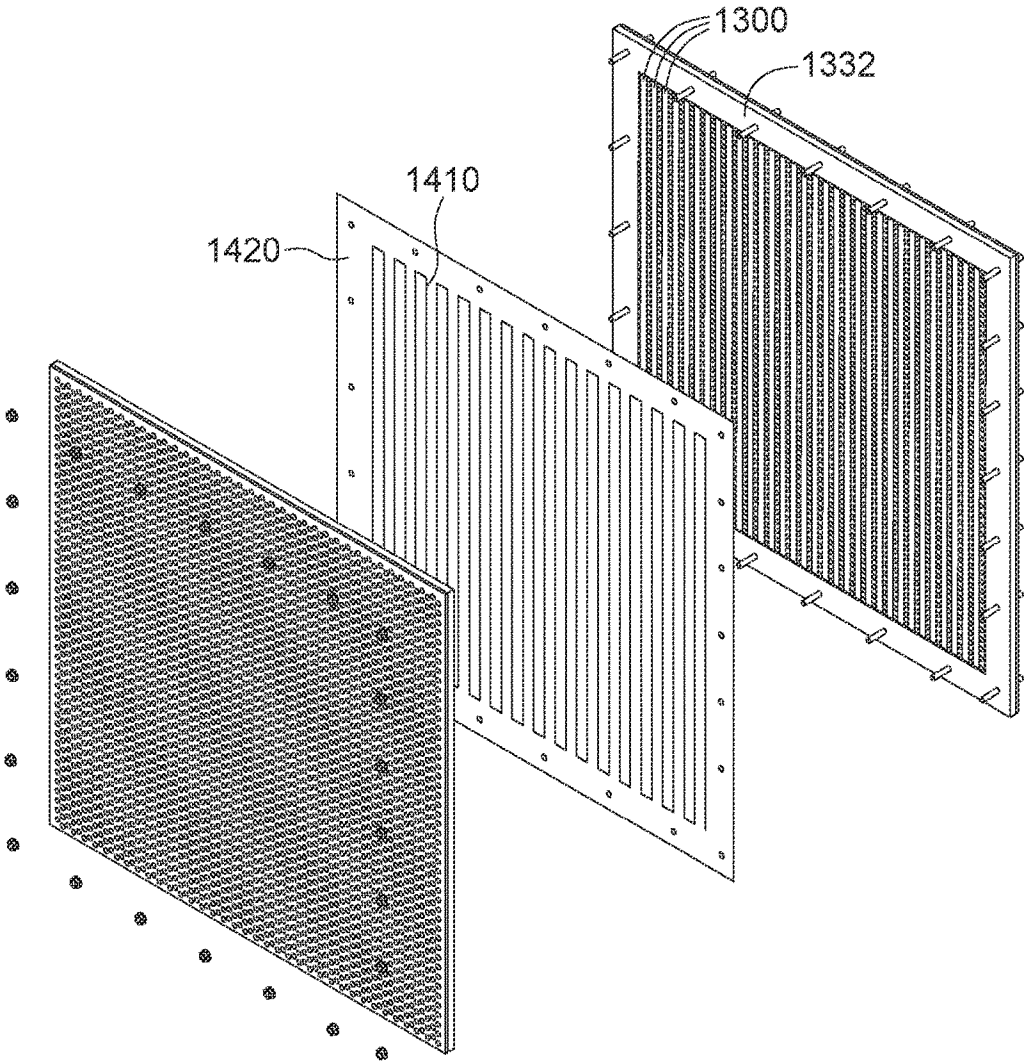
FIG. 15*e* is an exploded view of the sound wave generation apparatus of FIG. 15; and (xxiii)
Figure 15D:
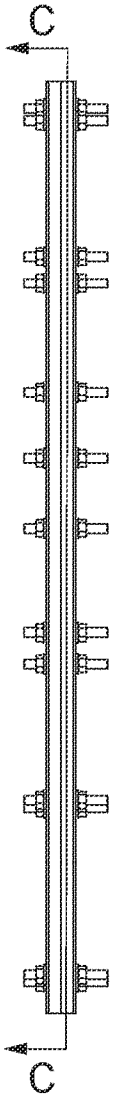
FIG. 15*d* is a side elevation view of the sound wave generation apparatus of FIG. 15.

An embodiment of the invention was tested by Tangent Design Engineering Ltd, implementing the methods and materials described in this paragraph and illustrated at FIGS. 15-15*e*. In this embodiment, a wire 1410 is laminated onto a membrane 1420. The membrane is sandwiched between two plates 1330*a* and 1330*b*. An first microphone 1201 is positioned approximately 50 cm from the plate 1330*a* in a first direction perpendicular to the plate 1330*a* and away from plate 1330*b*, and a second microphone 1202 is positioned approximately 50 cm from plate 1330*b* in a second direction opposite the first direction. Each plate has elongate, planar magnets 1300 secured to the side of the plate facing the membrane. Both plates are perforated. The magnets are arranged parallel to one another, and the magnets of plate 1330*a* are lined up with the magnets of plate 1330*b*. The wire 1410 is arranged in a zig-zag arrangement such that the wire has lengths, each length being positioned along centre lines defined between two neighbouring magnets of plate 1330*a* and their corresponding magnets of plate 1330*b*. There is a spacer 1332 along each edge of each of the plates, between each plate and the membrane. The apparatus 1000 is held together with nuts 1950 threaded onto bolts 1960 that pass through corresponding holes 1970 in the plate, spacer, and membrane located along the perimeter of the apparatus, with a washer 1952 positioned between each nut and the plate. The membrane and the wire laminated therein are held under tension by the force the spacers of each plate being urged against each other with the membrane therebetween.

Figure 16:
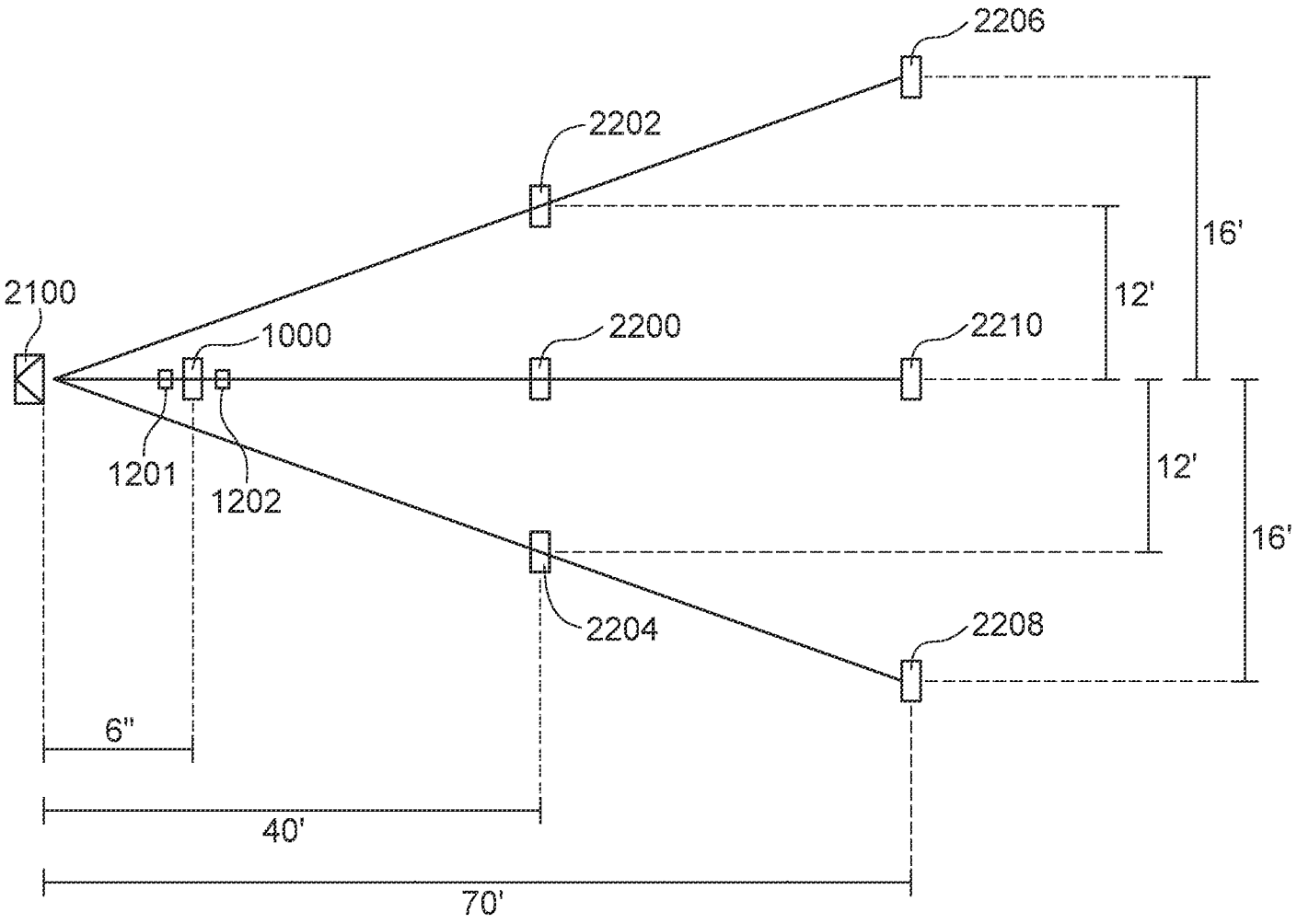
FIG. 16 is a top plan schematic of a test environment of a sound wave generation apparatus.

With reference to FIG. 16, the apparatus 1000 was positioned approximately 6 in (15.24 cm) in a first direction from a noise source speaker 2100. A first test microphone 2200 was positioned approximately 40 ft (12.19 m) in the first direction from the noise source speaker. A second test microphone 2210 was positioned approximately 70 ft (21.34 m) in the first direction from the noise source speaker. A third test speaker 2202 was positioned approximately 12 ft (3.67 m) from the first test microphone 2200 in a second direction, substantially perpendicular to the first direction. A fourth test speaker 2204 was positioned approximately 12 ft (3.67 m) from the first test microphone 2200 in a third direction, substantially opposite to the first direction. A fifth test speaker 2206 was positioned approximately 16 ft (4.88 m) from the second test microphone 2210 in the second direction. A sixth test speaker 2208 was positioned approximately 16 ft (4.88 m) from the second test microphone 2210 in the third direction. A second test was conducted with the apparatus 1000 being positioned approximately 13 ft in the first direction from the noise source speaker 2100, with the test microphones remaining in the same locations.

A 1 kHz sinewave was emitted from the noise source speaker. Measurements of perceived sound were measured by each of the test speakers. The apparatus was caused to emit the same frequency sinewave as the noise source speaker, shifted in phase by 180°. Reduction in noise of approximately 12.2 dB was observed at the test speakers after the apparatus 1000 was activated.

Clauses

Clause 1. A method for sound wave generation, comprising sensing one or more characteristics of a sound wave; calculating an inverted sound wave based on the one or more characteristics; and emitting the inverted sound wave by flowing a current, selected according to the inverted sound wave, through a wire under tension that passes through a positive pole of a magnet and a negative pole of the magnet, thereby causing the wire to vibrate.

Clause 2. The method of any one or more of clauses 1-17, wherein sensing includes sensing at a plurality of locations.

Clause 3. The method of any one or more of clauses 1-17, wherein the plurality of locations includes a first location and a second location, and calculating further includes computing a speed of sound between the first location and the second location based on a distance between the first location and the second location, and the one or more characteristics detected over a period of time at each of the first location and the second location.

Clause 4. The method of any one or more of clauses 1-17, wherein the one or more characteristics includes one or more of a frequency and an amplitude.

Clause 5. The method of any one or more of clauses 1-17, wherein: sensing includes using a microphone configured to detect one or more characteristics of a sound wave detected in a predetermined vicinity of the microphone; calculating includes using a processor coupled to the microphone, configured to calculate an inverted sound wave based on the one or more characteristics; emitting includes using at least one emitter module coupled to the processor, each emitter module including one or more magnets with a positive pole and a negative pole, a wire, made of a conductive material, under tension, that passes between the positive pole and the negative pole, and a power supply configured to deliver a current passing through the wire, the current selected by the processor to vibrate the wire and thereby emit the inverted sound wave; the one or more magnets including first, second, third, and fourth magnets, each being elongate and planar, arranged in a rectangular shape such that each occupies a corner of the rectangular shape, the first and third magnets oriented such that their north poles face each other, the second and fourth magnets oriented such that their south poles face each other, the first and second magnets being coupled to a first plate, the third and fourth magnets being coupled to a second plate, defining therebetween a centre line; the first plate and the second plate each plate being a planer member; the wire being coupled to a membrane under tension; and the wire being positioned such that it extends substantially along the centre line.

Clause 6. An apparatus for sound wave generation, comprising: a microphone configured to detect one or more characteristics of a sound wave detected in a predetermined vicinity of the microphone; a processor coupled to the microphone, configured to calculate an inverted sound wave based on the one or more characteristics; a power supply; and at least one emitter module coupled to the processor, each emitter module including one or more magnets with a positive pole and a negative pole, a wire, made of a conductive material, under tension, that passes between the positive pole and the negative pole, and the power supply configured to deliver a current passing through the wire, the current selected by the processor to vibrate the wire and thereby emit the inverted sound wave.

Clause 7. The apparatus of any one or more of clauses 1-17, wherein the microphone is positioned within 1 cm of at least one of the one or more wires.

Clause 8. The apparatus of any one or more of clauses 1-17, wherein the at least one emitter module includes a first emitter module and a second emitter module, and wherein the wire of the first emitter module is substantially parallel to and positioned within 1 cm of the wire of the second emitter module.

Clause 9. The apparatus of any one or more of clauses 1-17, wherein the at least one emitter module includes a first emitter module and a second emitter module, and wherein the wire of the first emitter module is substantially perpendicular to the wire of the second emitter module.

Clause 10. The apparatus of any one or more of clauses 1-17, further comprising a second microphone spaced a distance from the microphone; and the processor being further configured to calculate a speed of sound between the microphone and the second microphone based on the distance, and by comparing the sound waves detected over a period of time by the microphone and the second microphone; and the one or more characteristics includes the speed of sound.

Clause 11. The apparatus of any one or more of clauses 1-17, wherein the one or more characteristics includes one or more of a frequency and an amplitude.

Clause 12. The apparatus of any one or more of clauses 1-17, further comprising being installed in association with a structure.

Clause 13. The apparatus of any one or more of clauses 1-17, wherein the structure is one or more of a wall, a tarp, a screen and a fence.

Clause 14. The apparatus of any one or more of clauses 1-17, further comprising being installed on a frame.

Clause 15. The apparatus of any one or more of clauses 1-17, wherein the frame is for a window installation.

Clause 16. The apparatus of any one or more of clauses 1-17, further comprising: a first plate and a second plate, each plate being a planer member; a membrane under tension; the one or more magnets including first, second, third, and fourth magnets, each being elongate and planar, arranged in a rectangular shape such that each occupies a corner of the rectangular shape, the first and third magnets oriented such that their north poles face each other, the second and fourth magnets oriented such that their south poles face each other, the first and second magnets being coupled to the first plate, the third and fourth magnets being coupled to the second plate, defining therebetween a centre line; the wire being coupled to the membrane; and the wire being positioned such that it extends substantially along the centre line.

Clause 17. An apparatus for sound wave generation, comprising: a microphone configured to detect one or more characteristics of a sound wave detected in a predetermined vicinity of the microphone; a processor coupled to the microphone, configured to calculate an inverted sound wave based on the one or more characteristics; a power supply; a first plate and a second plate arranged in parallel planes with a space between them, each plate being a planer member; a membrane under tension being positioned in the space between the first plate and the second plate; and at least one emitter module coupled to the processor, each emitter module including four or more magnets, each with a positive pole and a negative pole, including first, second, third, and fourth magnets, each being elongate and planar, arranged in a rectangular shape such that each occupies a corner of the rectangular shape, the first and third magnets oriented such that their north poles face each other, the second and fourth magnets oriented such that their south poles face each other, the first and second magnets being coupled to the first plate, the third and fourth magnets being coupled to the second plate, defining a centre line between the four magnets; a wire, made of a conductive material, coupled to the membrane and thereby being under tension, positioned such that the wire extends substantially along the centre line, and the power supply configured to deliver a current passing through the wire, the current selected by the processor to vibrate the wire and thereby emit the inverted sound wave.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A method for sound wave generation, comprising sensing one or more characteristics of a sound wave by using a microphone configured to detect the one or more characteristics in a predetermined vicinity of the microphone;

calculating an inverted sound wave based on the one or more characteristics using a processor coupled to the microphone, configured to calculate the inverted sound wave based on the one or more characteristics;

providing a wire; and emitting the inverted sound wave by flowing a current, selected by the processor according to the inverted sound wave, through the wire, thereby causing the wire to vibrate;

the wire being coupled to a membrane under tension;

the wire being positioned such that it extends substantially along a centre line between four or more magnets including first, second, third, and fourth magnets, each being elongate and planar, arranged in a rectangular shape such that each occupies a corner of the rectangular shape, the first and third magnets oriented such that their north poles face each other, the second and fourth magnets oriented such that their south poles face each other, the first and second magnets being coupled to a first plate, the third and fourth magnets being coupled to a second plate, defining therebetween the centre line; and the first plate and the second plate each plate being a planer member.

2. The method of claim 1, wherein sensing includes sensing at a plurality of locations.

3. The method of claim 2, wherein the plurality of locations includes a first location and a second location, and calculating further includes computing a speed of sound between the first location and the second location based on a distance between the first location and the second location, and the one or more characteristics detected over a period of time at each of the first location and the second location.

4. The method of claim 1, wherein the one or more characteristics includes one or more of a frequency and an amplitude.

5. An apparatus for sound wave generation, comprising:

a microphone configured to detect one or more characteristics of a sound wave detected in a predetermined vicinity of the microphone;

a processor coupled to the microphone, configured to calculate an inverted sound wave based on the one or more characteristics;

a power supply; and a first plate and a second plate, arranged in parallel planes with a space between them, each plate being a planer member;

a membrane under tension being positioned in the space between the first plate and the second plate; and at least one emitter module coupled to the processor, each emitter module including four or more magnets, each with a positive pole and a negative pole, including first, second, third, and fourth magnets, each being elongate and planar, arranged in a rectangular shape such that each occupies a corner of the rectangular shape, the first and third magnets oriented such that their north poles face each other, the second and fourth magnets oriented such that their south poles face each other, the first and second magnets being coupled to the first plate, the third and fourth magnets being coupled to the second plate, defining a centre line between the four magnets;

a wire, made of a conductive material, coupled to the membrane and thereby being under tension, positioned such that the wire extends substantially along the centre line, and the power supply configured to deliver a current passing through the wire, the current selected by the processor to vibrate the wire and thereby emit the inverted sound wave.

6. The apparatus of claim 5, wherein the microphone is positioned within 1 cm of at least one of the one or more wires.

7. The apparatus of claim 5, wherein the at least one emitter module includes a first emitter module and a second emitter module, and wherein the wire of the first emitter module is substantially parallel to and positioned within 1 cm of the wire of the second emitter module.

8. The apparatus of claim 5, wherein the at least one emitter module includes a first emitter module and a second emitter module, and wherein the wire of the first emitter module is substantially perpendicular to the wire of the second emitter module.

9. The apparatus of claim 5, further comprising a second microphone spaced a distance from the microphone; and the processor being further configured to calculate a speed of sound between the microphone and the second microphone based on the distance, and by comparing the sound waves detected over a period of time by the microphone and the second microphone; and the one or more characteristics includes the speed of sound.

10. The apparatus of claim 5, wherein the one or more characteristics includes one or more of a frequency and an amplitude.

11. The apparatus of claim 5, further comprising being installed in association with a structure.

12. The apparatus of claim 11, wherein the structure is one or more of a wall, a tarp, a screen and a fence.

13. The apparatus of claim 5, further comprising being installed on a frame.

14. The apparatus of claim 13, wherein the frame is for a window installation.

15. The apparatus of claim 5, wherein the wire is laminated between two sheets of the membrane.

16. The apparatus of claim 5, wherein the wire is arranged in a zig-zag arrangement such that the wire has two or more lengths, at least one length of the two or more lengths being positioned substantially parallel to the centre line.

17. The apparatus of claim 5, wherein one or both of the first plate and the second plate is perforated.

18. The apparatus of claim 5, wherein the four or more magnets are arranged parallel to one another, and the magnets coupled to the first plate are lined up with the magnets coupled to the second plate.

* * * * *